US009788669B1

(12) United States Patent
Denby et al.

(10) Patent No.: US 9,788,669 B1
(45) Date of Patent: Oct. 17, 2017

(54) PRODUCT DISPLAY FIXTURE

(71) Applicant: TARGET BRANDS, INC., Minneapolis, MN (US)

(72) Inventors: Scott E. Denby, Minneapolis, MN (US); Chad G. Davis, Cambridge, MN (US)

(73) Assignee: TARGET BRANDS, INC., Minneapolis, MN (US)

( * ) Notice: Subject to any disclaimer, the term of this patent is extended or adjusted under 35 U.S.C. 154(b) by 0 days.

(21) Appl. No.: 15/421,434

(22) Filed: Jan. 31, 2017

(51) Int. Cl.

| | |
|---|---|
| ***A47F 7/28*** | (2006.01) |
| ***A47F 5/00*** | (2006.01) |
| ***E05B 73/00*** | (2006.01) |
| ***A47F 7/024*** | (2006.01) |

(52) U.S. Cl.
CPC ..... *A47F 7/286* (2013.01); *A47F 5/0043* (2013.01); *A47F 7/024* (2013.01); *E05B 73/0041* (2013.01)

(58) Field of Classification Search
CPC ..... A47F 7/024; A47F 3/002; A47F 5/0043; A47F 7/0243; A47F 7/0246; A47F 7/286; A47F 7/28; A61J 9/00; A61J 9/06; G09F 11/23; G09F 11/00; Y10T 29/49826; E05B 73/0041; E05B 73/0017; B43K 23/002
USPC ..... 211/74
See application file for complete search history.

(56) References Cited

U.S. PATENT DOCUMENTS

| | | | | |
|---|---|---|---|---|
| 2,283,194 A | | 5/1942 | Edwards | |
| 2,467,873 A | | 4/1949 | Weir | |
| 2,600,755 A | * | 6/1952 | Greensfelder | A47J 47/16 211/106 |
| 2,870,915 A | | 1/1959 | Adams et al. | |
| 2,879,900 A | * | 3/1959 | Fox | A47L 19/00 211/74 |
| 4,101,042 A | | 7/1978 | Strong et al. | |
| 4,120,401 A | | 10/1978 | Newman | |
| 4,486,169 A | * | 12/1984 | Lewis | F23Q 2/34 206/85 |
| 5,000,332 A | * | 3/1991 | Whitacre | B65D 55/02 215/232 |
| 5,246,183 A | | 9/1993 | Leyden | |

(Continued)

OTHER PUBLICATIONS

Photographs of Product Displays Publicly Used in Target Stores, Admitted Prior Art (2 pages).

*Primary Examiner* — Ko Hung Chan
(74) *Attorney, Agent, or Firm* — JoAnn M. Seaton; Griffiths & Seaton PLLC

(57) ABSTRACT

A display fixture for supporting a sample product comprises a platform segment, a tether assembly, and a coupling plate. The platform segment defines a top surface, a bottom surface, and an aperture extending from the top surface to the bottom surface. The tether assembly includes a tether housing positioned below the bottom surface of the platform segment and a tether extending from the tether housing and through the aperture of the platform segment. The tether is selectively retractable from the tether housing and is biased toward maintenance inside the tether housing. The coupling plate defines a slot extending from an outer perimeter thereof into an interior thereof. The slot terminates at an enlarged end opposite the outer perimeter. The tether extends through the slot and terminates in a ball end. The ball end nests in the enlarged end of the slot to couple the tether to the coupling plate.

19 Claims, 9 Drawing Sheets

(56) References Cited

U.S. PATENT DOCUMENTS 5,358,348 A * 10/1994 Kennedy ..... B43K 23/002 211/69.1
5,406,717 A * 4/1995 Dofka ..... D06F 59/04 211/37
5,685,436 A * 11/1997 Davet ..... A47F 7/024 211/163
5,699,591 A * 12/1997 Kane ..... E05B 73/0005 24/114.6
6,019,304 A 2/2000 Skowronski et al.
6,039,496 A 3/2000 Bishop
6,167,596 B1 * 1/2001 Berman ..... B43K 23/04 211/69.5
6,629,617 B2 * 10/2003 Osawa ..... A47F 5/16 211/119.003
7,461,989 B1 * 12/2008 Dickover ..... B43K 23/002 401/131
7,566,185 B2 7/2009 Samuelson et al.
7,654,399 B2 2/2010 Scholen et al.
8,079,478 B2 12/2011 Short et al.
8,172,474 B2 * 5/2012 Dickover ..... B43K 23/002 24/3.13
8,292,097 B2 10/2012 Goldberg
8,360,373 B2 1/2013 Johnson et al.
8,413,821 B2 4/2013 Johnson et al.
8,523,122 B2 9/2013 Johnson et al.
8,558,688 B2 10/2013 Henson et al.
8,711,553 B2 4/2014 Trinh et al.
8,763,819 B2 7/2014 Theisen et al.
8,814,128 B2 8/2014 Trinh et al.
8,994,798 B2 3/2015 Trinh et al.
9,030,322 B2 5/2015 Johnson et al.
9,060,625 B2 6/2015 Theisen et al.
9,125,501 B2 9/2015 Reynolds et al.
9,277,832 B2 3/2016 Theisen et al.
D763,019 S 8/2016 Theisen et al.
D773,219 S 12/2016 Clouse et al.
2007/0023557 A1 2/2007 Rankin, VI
2008/0035778 A1 2/2008 Belden et al.
2009/0229089 A1 * 9/2009 Galant ..... A47F 5/16 24/303
2015/0182039 A1 7/2015 Theisen et al.

* cited by examiner

PRODUCT DISPLAY FIXTURE

BACKGROUND OF THE INVENTION

Display fixtures are used in retail stores or other environments to present samples of various products to consumers. The display fixtures provide consumers with the opportunity to handle or use a sample product before purchasing a similar product provided in a sealed package. In this manner, consumers are able to make a more informed decision about whether to buy a product while still receiving a pristine, non-handled version of the product should they decide to make a corresponding purchase. The product in the sealed package may be readily available on a shelf or other area near the display fixture and/or may be securely held in an area accessible only by retail store team members.

SUMMARY

One embodiment of the invention relates to a display fixture for supporting a sample product on a retail display shelf. The display fixture comprises a platform segment, a tether assembly, and a coupling plate. The platform segment defines a top surface, a bottom surface, and an aperture extending from the top surface to the bottom surface. The tether assembly includes a tether housing positioned below the bottom surface of the platform segment and a tether extending from the tether housing and through the aperture of the platform segment. The tether is selectively retractable from the tether housing and is biased toward maintenance inside the tether housing. The coupling plate has an outer perimeter and a slot extending from the outer perimeter into an interior of the coupling plate. The slot terminates at an enlarged end opposite the outer perimeter. The tether extends through the slot and terminates in a ball end. The ball end nests in the enlarged end of the slot such that the tether is coupled to the coupling plate. Other product display fixtures, assemblies, and associated methods are also described herein.

BRIEF DESCRIPTION OF THE DRAWINGS

Embodiments of the invention will be described with respect to the figures, in which like reference numerals denote like elements, and in which.

DETAILED DESCRIPTION

The following detailed description of the invention provides example embodiments and is not intended to limit the invention or the application and uses of the invention. Furthermore, there is no intention to be bound by any theory presented in the preceding background of the invention or the following detailed description of the invention. Relational terms herein such a first, second, top, bottom, etc. may be used herein solely to distinguish one entity or action from another without necessarily requiring or implying an actual such relationship or order. In addition, as used herein, the term "about" or "substantially" apply to all numeric values or descriptive terms, respectively, and generally indicate a range of numbers or characteristics that one of skill n the art would consider equivalent to the recited values or terms, that is, having the same function or results.

This innovation provides a display fixture for use in a retail display or other environment for supporting sample products on a platform. In one embodiment, the display fixture includes flanges below the platform for selective coupling with a shelf of a display fixture. A tether system is mounted below the platform and coupled to a first sample product above the platform in a manner allowing the first sample product to be pulled away from the display fixture for manipulation and examination by a consumer. In one example, the first sample product is a baby bottle, and the tether is coupled to the baby bottle using a coupling plate maintained inside the baby bottle. In one example, a second sample product, such as a nipple assembly for a baby bottle, is statically secured to the top of the platform for consumer inspection. While primarily described herein as supporting a baby bottle and associated components as the sample products, other sample products may alternatively be displayed on the display fixture.

In one embodiment, the display fixture provides a platform raising the sample products from a shelf of the retail display and forming a sign holder on a front of the display fixture. Display fixture is configured for ready securement to the shelf in a manner making use of existing apertures in common retail shelves. For example, the display fixture includes hooks near a front or rear thereof for selective receipt within apertures of a retail shelf and an opposing screw, bolt, or other static securement mechanism being statically received within apertures at an opposite longitudinal edge of the retail shelf.

Figure 1:
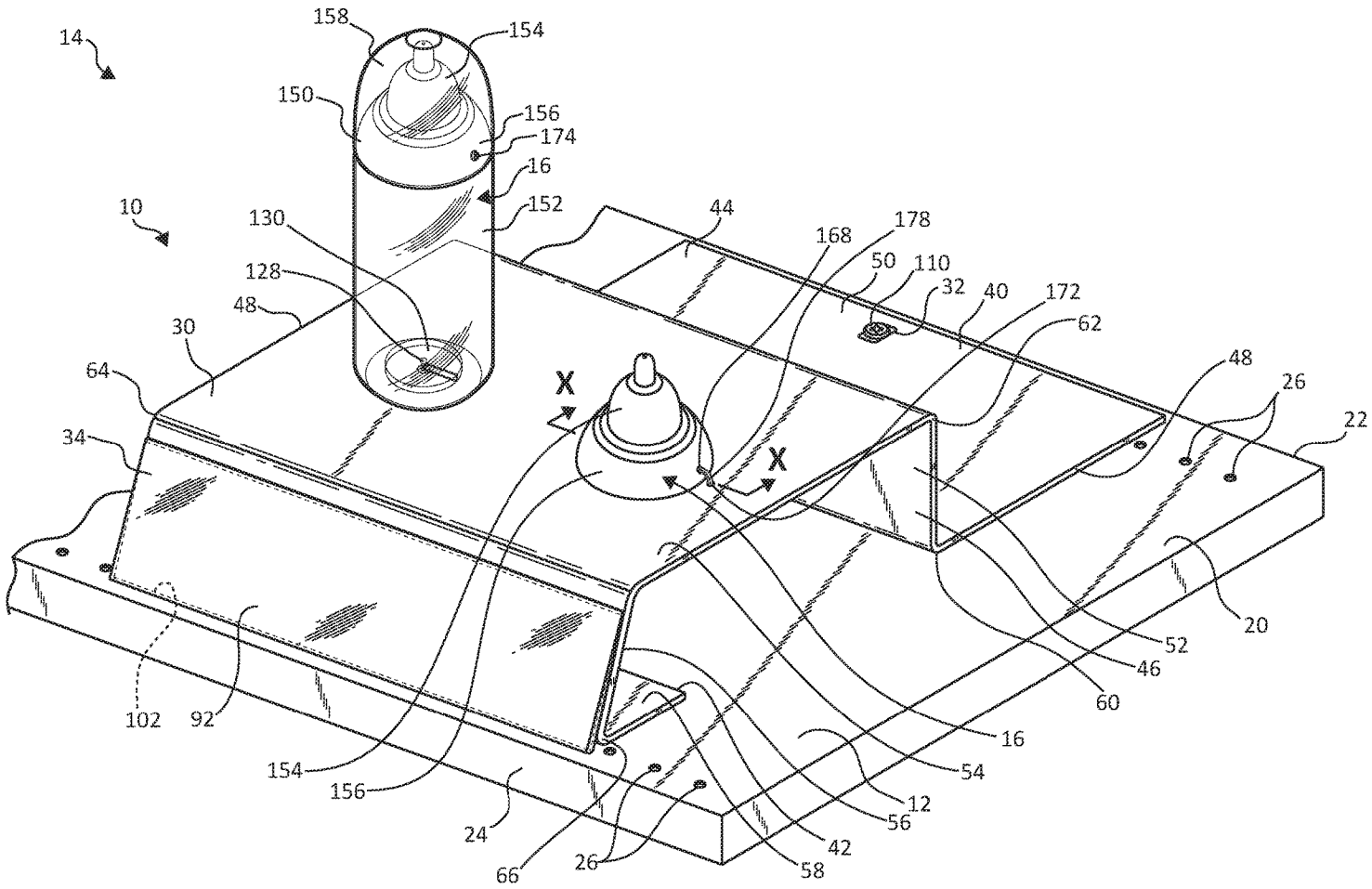
FIG. 1 is a front perspective view illustration of a display fixture installed as part of a retail display with sample products coupled thereto, according to one embodiment of the present invention.
Figure 2:
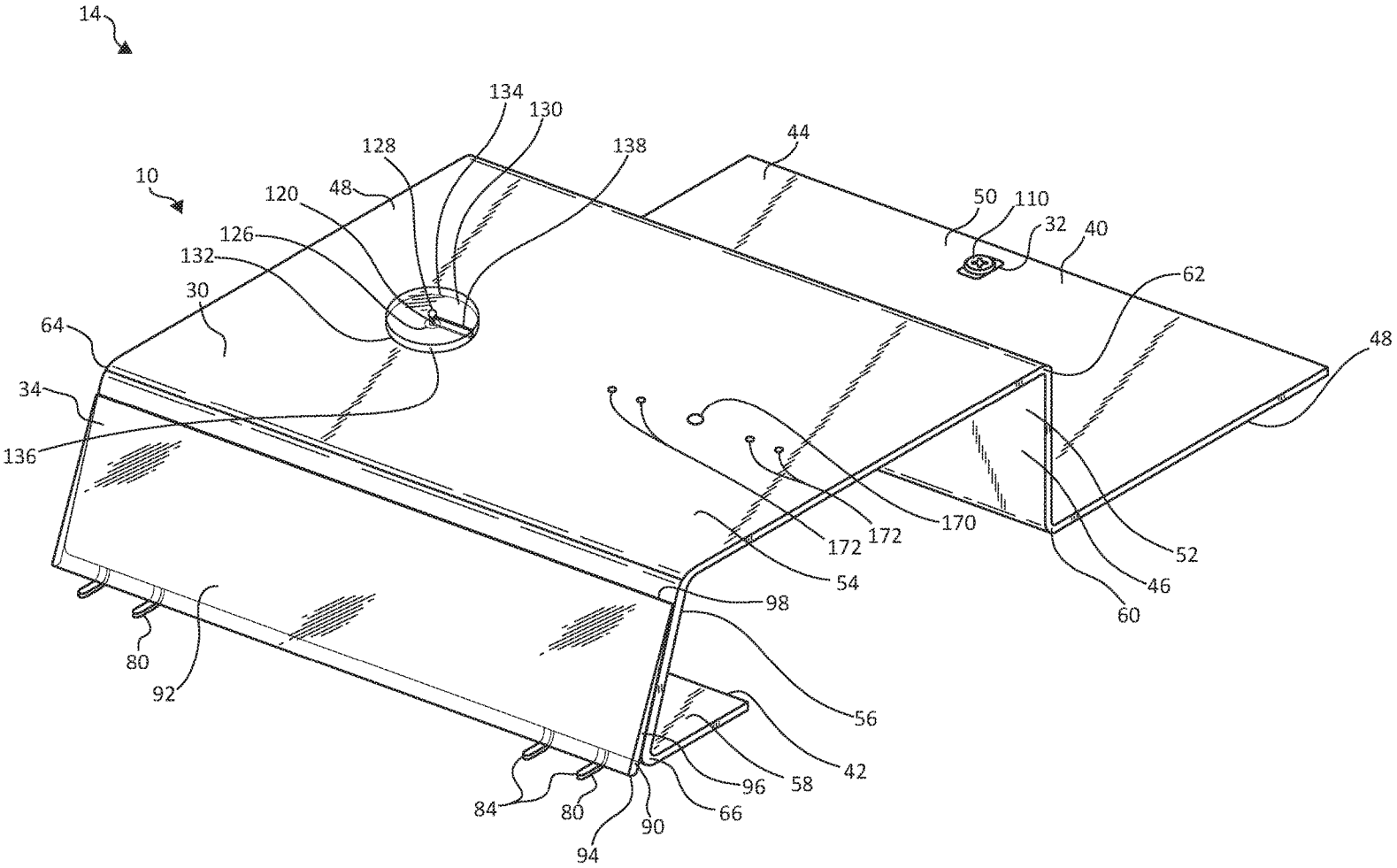
FIG. 2 is a front perspective view illustration of the display fixture, according to one embodiment of the present invention.
Figure 3:
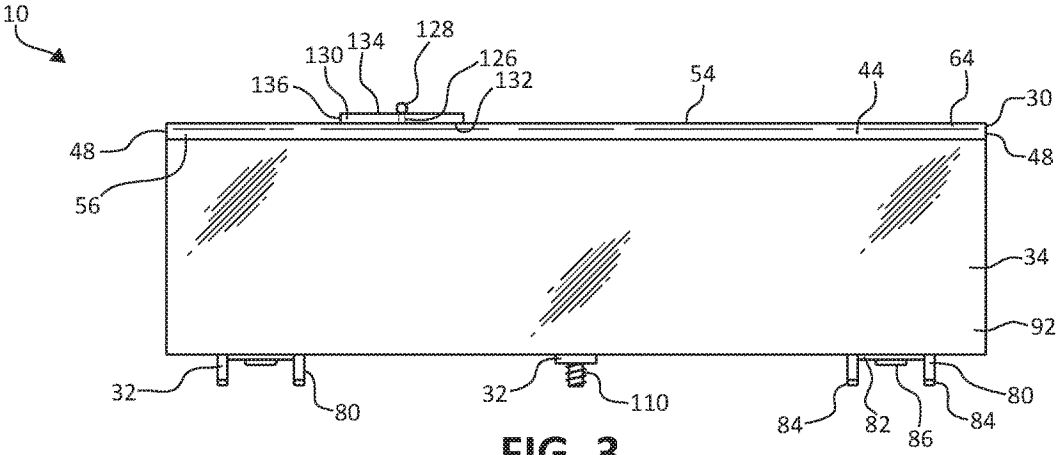
FIG. 3 is a front view illustration of the display fixture of FIG. 2, according to one embodiment of the present invention.
Figure 4:
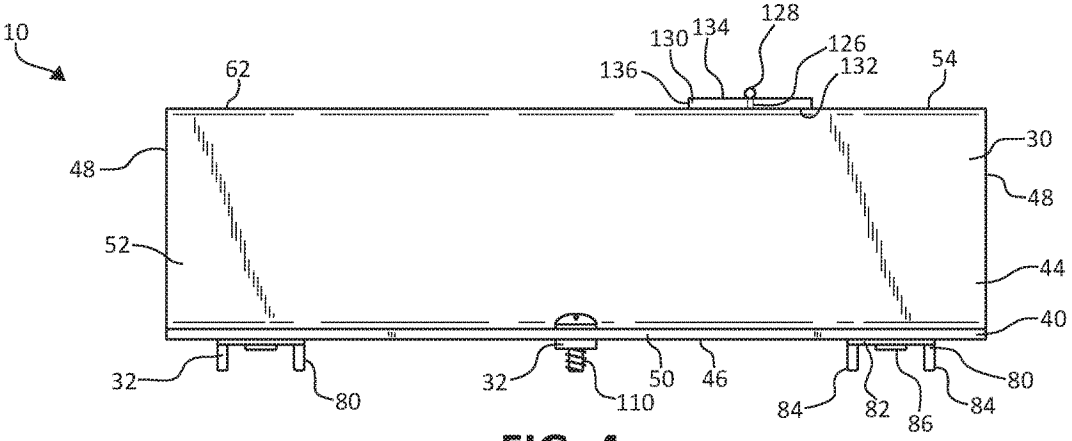
FIG. 4 is a rear view illustration of the display fixture of FIG. 2, according to one embodiment of the present invention.
Figure 5:
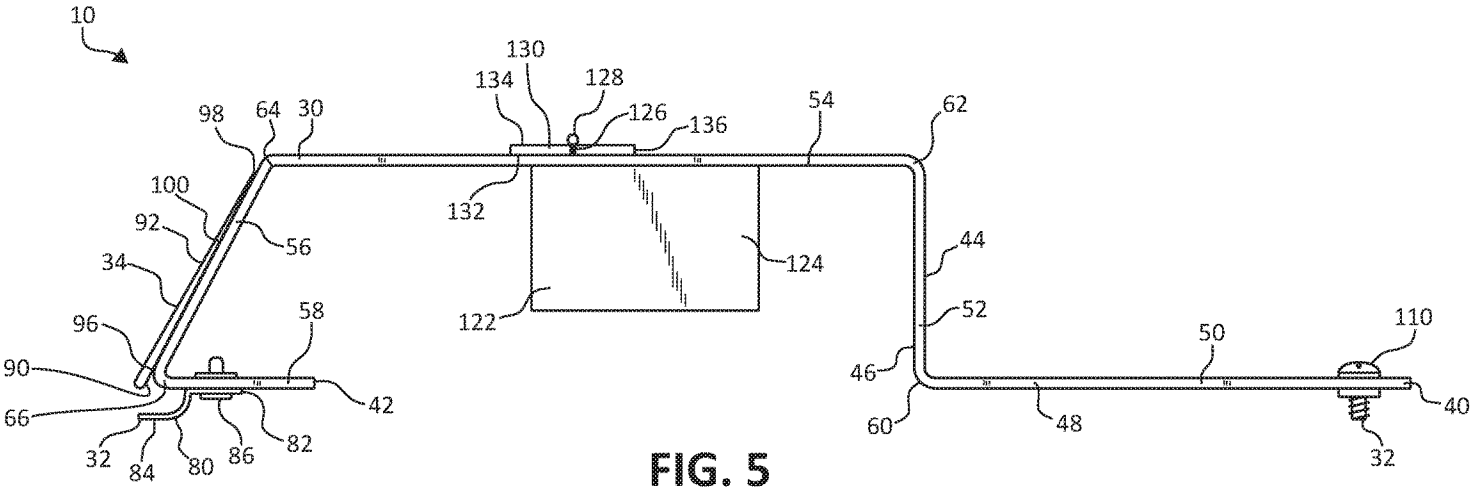
FIG. 5 is a right side vie illustration of the display fixture of FIG. 2, according to one embodiment of the present invention.
Figure 6:
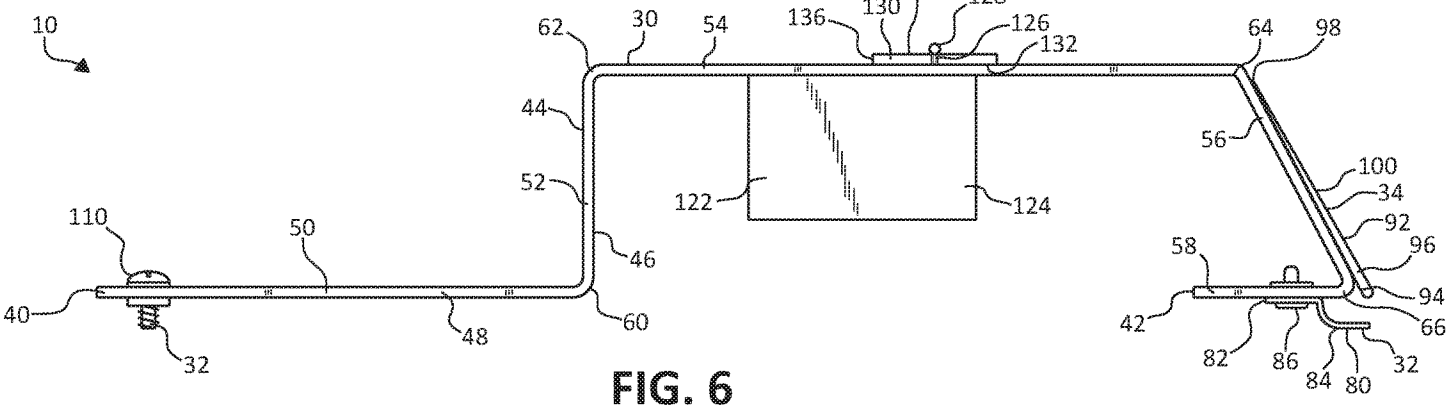
FIG. 6 is a left side view illustration of the display fixture of FIG. 2, according to one embodiment of the present invention.
Figure 7:
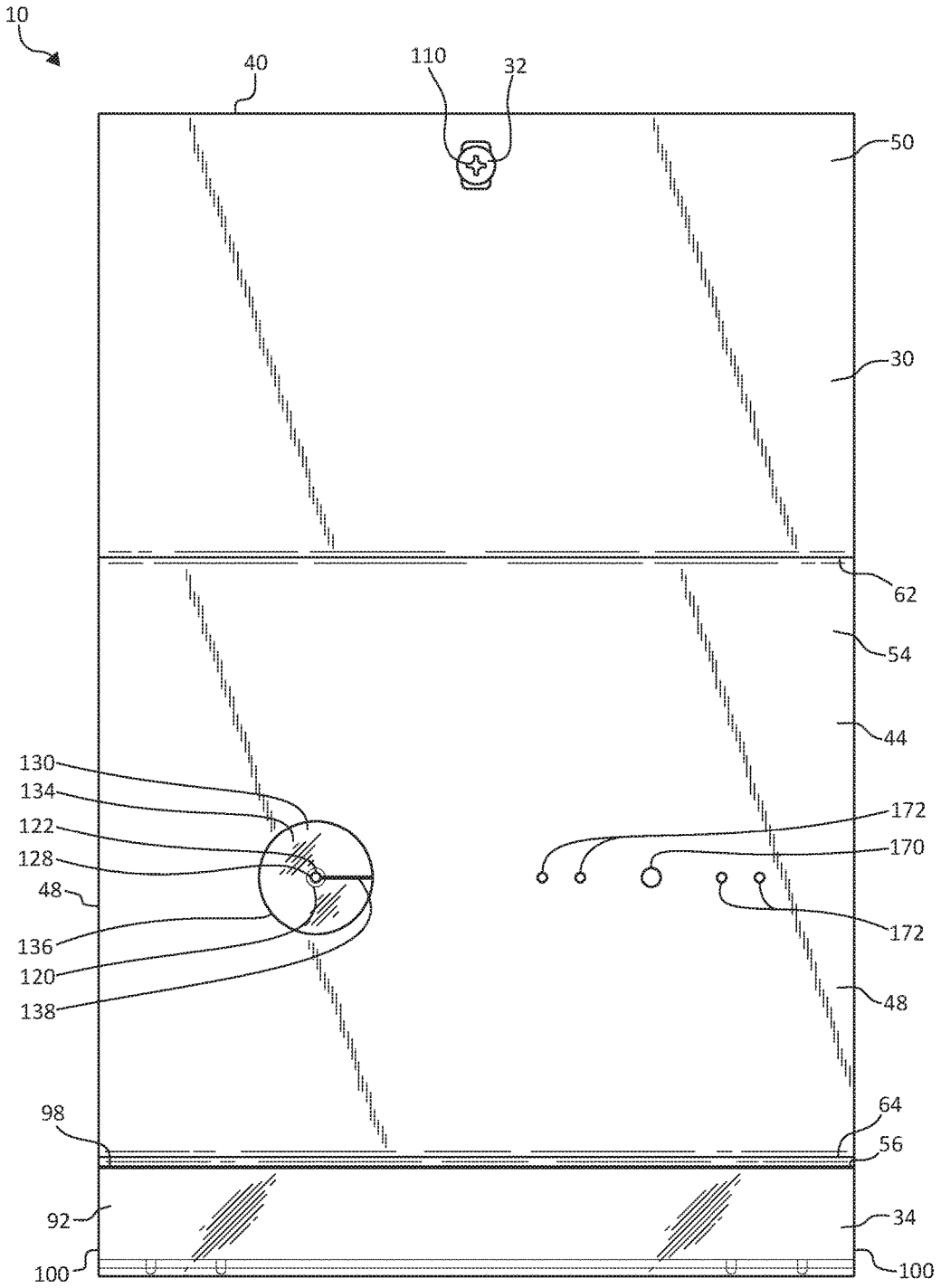
FIG. 7 is a top view illustration of the display fixture of FIG. 2, according to one embodiment of the present invention.
Figure 8:
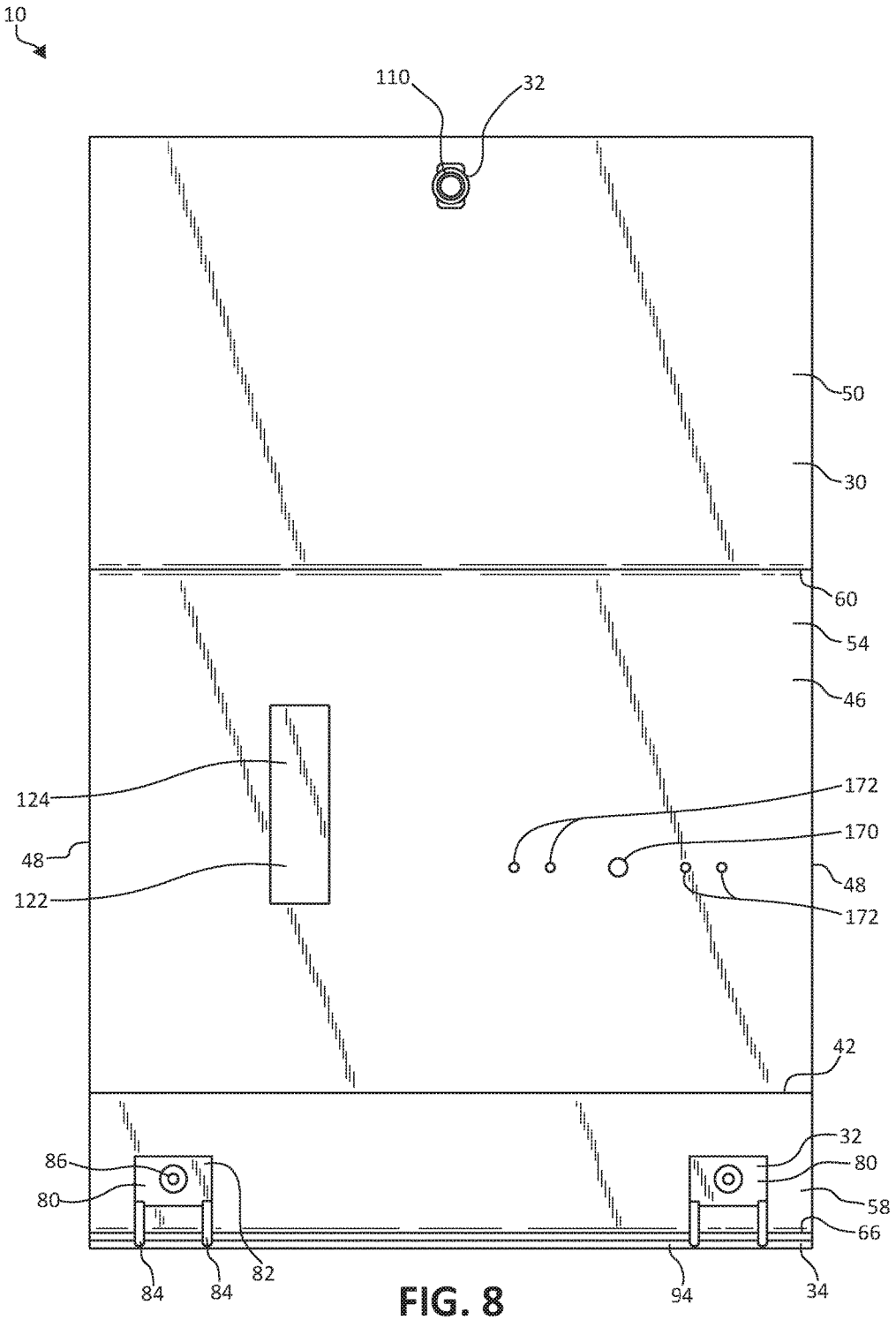
FIG. 8 is a bottom view illustration of the display fixture of FIG. 2, according to one embodiment of the present invention.

Turning to the Figures, FIG. 1 illustrates display fixture 10 according to one embodiment of the present invention mounted on a shelf 12 of a retail display system 14 to support at least one sample product 16. In one embodiment, retail display shelf 12 defines a top panel 20, rear edge 22, and a front edge 24. Top panel 20 includes at least one linear array of apertures 26 near each of an extending substantially parallel to each of front edge 24 and rear edge 22, in one example. In one embodiment, retail display shelf 12 is a standard retail display shelf 12 having apertures 26 extending along edges of top panel 20 near each of front edge 24 and rear edge 22. Display fixture 10 extends upwardly from top panel 20 of shelf 12 supporting the at least one sample product 16 above top panel 20. Display fixture 10 is selectively and statically secured to retail display shelf 12, for example, by using apertures 26 of retail display shelf 12.

In one example, display fixture 10 includes a primary support 30, coupling members 32, and/or a sign holder 34. Primary support 30 is configured to be coupled with a retail display shelf 12 via coupling members 32 and to support sample product 16. In one embodiment, primary support 30 further supports sign holder 34 at a front portion thereof configured to receive a sign 102 (generally indicated in FIG. 1 with broken lines) having sale, information, or other informational or marketing indicia (not shown) printed thereon.

Primary support 30 extends from a rear free edge 40 to a front free edge 42 and defines a first or exterior surface 44 and a second or interior surface 46 between opposing side edges 48. In one example, each of opposing side edges 48 extends substantially perpendicularly relative to each of rear free edge 40 and/or front free edge 42. Primary support 30 defines various bends or other transitions to form segments thereof. For example, primary support 30 defines a rear coupling flange 50, a riser segment 52, a platform segment 54, a front facing segment 56, and a front coupling flange 58 extending in sequence from rear free edge 40 to front free edge 42. In one embodiment, each of rear coupling flange 50, riser segment 52, platform segment 54, front facing segment 56, and front coupling flange 58 extend from on of opposing side edges 48 to the other of opposing side edges 48.

Rear coupling flange 50 extends forwardly from rear free edge 40 in a substantially planar manner such that exterior surface 44 faces upwardly and interior surface 46 faces downwardly. Rear coupling flange 50 continues forwardly to intersect riser segment 52 of primary support 30 along a boundary or intersecting line 60, which extends laterally adjacent to each of rear coupling flange 50 and riser segment 52. A depth of rear coupling flange 50, as measured from rear free edge 40 to riser segment 52 is selected to give primary support 30 an overall depth corresponding to retail display shelf 12, as will be apparent to those of skill in the art upon reading this application.

Riser segment 52 extends upwardly from intersecting line 60, for example, substantially perpendicularly relative to rear coupling flange 50 to platform segment 54. In one embodiment, platform segment 54 is upwardly offset from and/or substantially parallel to rear coupling flange 50. Platform segment 54 is substantially planar, in one example, and extends forwardly from riser segment 52 to a border or intersecting line 64 adjacent front facing segment 56. Front facing segment 56 extends downwardly to intersecting line 66 adjacent front coupling flange 58, and, in one embodiment, in which platform segment 54 is configured to extend substantially parallel to top panel 20 of shelf 12, with an overall height substantially equal to an overall height of riser segment 52. In one example, front facing segment 56 extends forwardly and downwardly from intersecting line 64 to intersecting line 66. Front coupling flange 58 extends from intersecting lines 66, which, in one embodiment, also is the forwardmost edge of primary support 30, rearwardly in a manner substantially parallel to and coplanar with rear coupling flange 50.

Primary support 30 is sized to fit on shelf 12 in a manner covering a substantial entirety of a shelf depth. For example, where shelf 12 includes an array of apertures 26 along each of front edge 24 and rear edge 22, primary support 30 is configured to be coupled with shelf 12 via each such array of apertures 26. In one embodiment, primary support 30 includes one or more coupling hooks 80, in one example, two coupling hooks 80, or other coupling members 32, coupled to front coupling flange 58. Each coupling hook 80 includes a coupling tab 82 and at least two prongs 84 extending downwardly and forwardly from a front edge thereof. Coupling hooks 80 are coupled with front coupling flange 58 via a rivet or other fastener(s) 86 extending through and/or otherwise being connected to each of coupling tab 82 and front coupling flange 58.

To couple primary support 30 to shelf 12, prongs 84 of coupling hooks 80 are inserted to corresponding apertures in the array of apertures 26 along front edge 24 of shelf 12. Primary support 30 is rotated downwardly to place both front coupling flange 58 and rear coupling flange 50 in direct contact with top panel 20 of shelf. To more fully secure primary support 30 to top panel 20, in one example, another at least one additional coupling member 32, such as a bolt and nut, rivet, or any other suitable rear fastener 110 is placed to extend through rear coupling flange 50 and through one of aperture of array of apertures 26 extending along rear edge 22. In this manner, primary support 30 is secured to prevent significant movement in the front-to-back, side-to-side, and up-and-down directions.

Platform segment 54 is configured to support sample products 16 for consumer inspection. Platform segment 54 includes a first aperture 120 (best illustrated in FIG. 13), extending therethrough between first exterior surface 44 and second exterior surface 46 of platform segment 54. In one example, primary support 30 includes a tether assembly 122 coupled to platform segment 54 adjacent first aperture 120, in a manner configured to secure a first one of sample products 16 thereto. More specifically, as illustrated in the figures, tether assembly 122 includes a tether housing 124, a tether 126 (see FIGS. 9 and 13), and a coupling plate 130. Tether 126 is a suitable cable that is retractable into and biased toward its retracted position in tether housing 124. In one embodiment, tether 126 is configured to be selectively wound into and unwound out of tether housing 124 about a spring loaded spool (not shown) within tether housing 124, as will be apparent to those of skill in the art upon reading the current application. The spring-loaded spool biases tether 126 to be pulled into and maintained within tether housing 124, such that force applied to an end of tether 126 opposite its securement to the spring-loaded spool is used to overcome the bias of tether 126 to pull a portion of tether 126 out of tether housing 124.

Tether housing 124 is secured to interior surface 46 of platform segment 54 such that tether 126 extends out of tether housing 124 and through first aperture 120 in platform segment 54. Tether housing 124 is biased to pull tether 126 into tether housing 124 while still allowing a length of tether 126 to be pulled out of tether housing 124 when the biasing force is overcome. An end of tether 126 opposite its securement to tether housing 124 includes a ball end 128 of other enlarged feature having overall dimensions greater than an overall thickness of a remainder of tether 126.

To maintain ball end 128 of tether 126 above platform segment 54, coupling plate 130 is secured adjacent ball end 128 and has an overall dimension greater than a diameter of first aperture 120. In this manner, the biasing force of tether assembly 122 is able to pull coupling plate 130 toward, but not through aperture 120. More specifically, in one embodiment, coupling plate 130 is substantially planar defining a first side 132, a second side 134, and a perimeter edge 136 extending between first side 132 and second side 134. Coupling plate 130 may be in the shape of a disc, polygon, or any other suitable shape and defines a slot 138 having a width just greater than the overall thickness of the primary portion of tether 126 and smaller than an overall dimension of ball end 128. In one example, slot 138 terminates at an interior end 140 of slot 138 opposite perimeter edge 136 at or near center of coupling plate 130. In one example, interior end 140 is formed as a circular end of slot 138 having a diameter greater than a width of a remainder of slot 138 such that interior end 140 is an enlarged end of slot 138.

Figure 10:
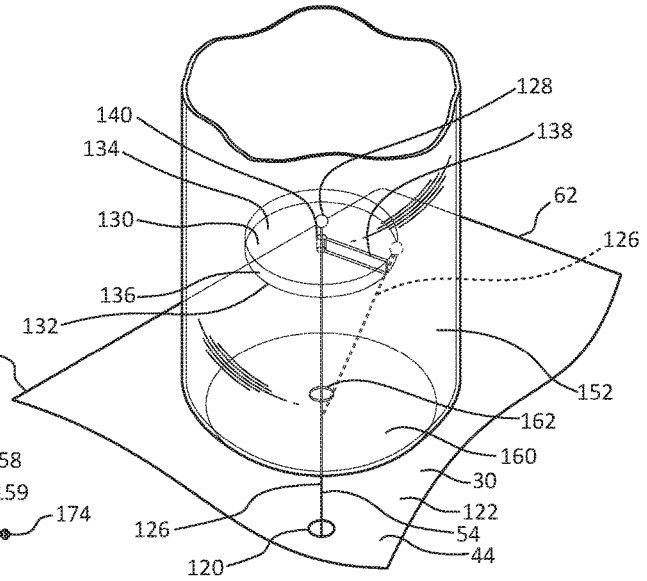
FIG. 10 is enlarged detail of the perspective view illustration of FIG. 9, according to one embodiment of the present invention.

Tether 126 is secured to coupling plate 130, as illustrated in broken lines in FIG. 10, at least partially by sliding tether 126 from perimeter edge 136, through slot 138 to interior end 140 of slot 138 opposite perimeter edge 136 at or very near a center of coupling plate 130. While slot 138 is sufficient wide to allow tether 126 to slide into a center of coupling plate 130, in one example, slot 138 is sufficiently narrow that such sliding requires force to overcome friction on tether 126 from sides of slot 138 such that tether 126 is not readily slid back out of slot 138. The enlargement of interior end 140 as compared to a remainder of slot 138 allows tether 126 to move out of alignment with the remainder of slot 138 while ball end 140 rests in interior end 140 of slot 138.

Tension on tether 126 from the bias of tether assembly 122 maintains ball end 128 pulled tightly against coupling plate 130 without need for additional fasteners or other securement devices to maintain tether 126 coupled with coupling plate 130. If product 16 would not be secured thereto, tension from tether assembly 122 pulls coupling plate 130 toward tether housing 124 such that coupling plate 130 fits tightly against platform segment 54 adjacent apertures 120. In one example, coupling plate 130 is formed of a single piece of substantially transparent material such that, even where bottle 152 and/or other portions of bottle assembly 150 are translucent and/or transparent, coupling plate 130 is not visually distracting from the details of product 16, such as bottle 152 and/or other portions of bottle assembly 150.

Figure 9:
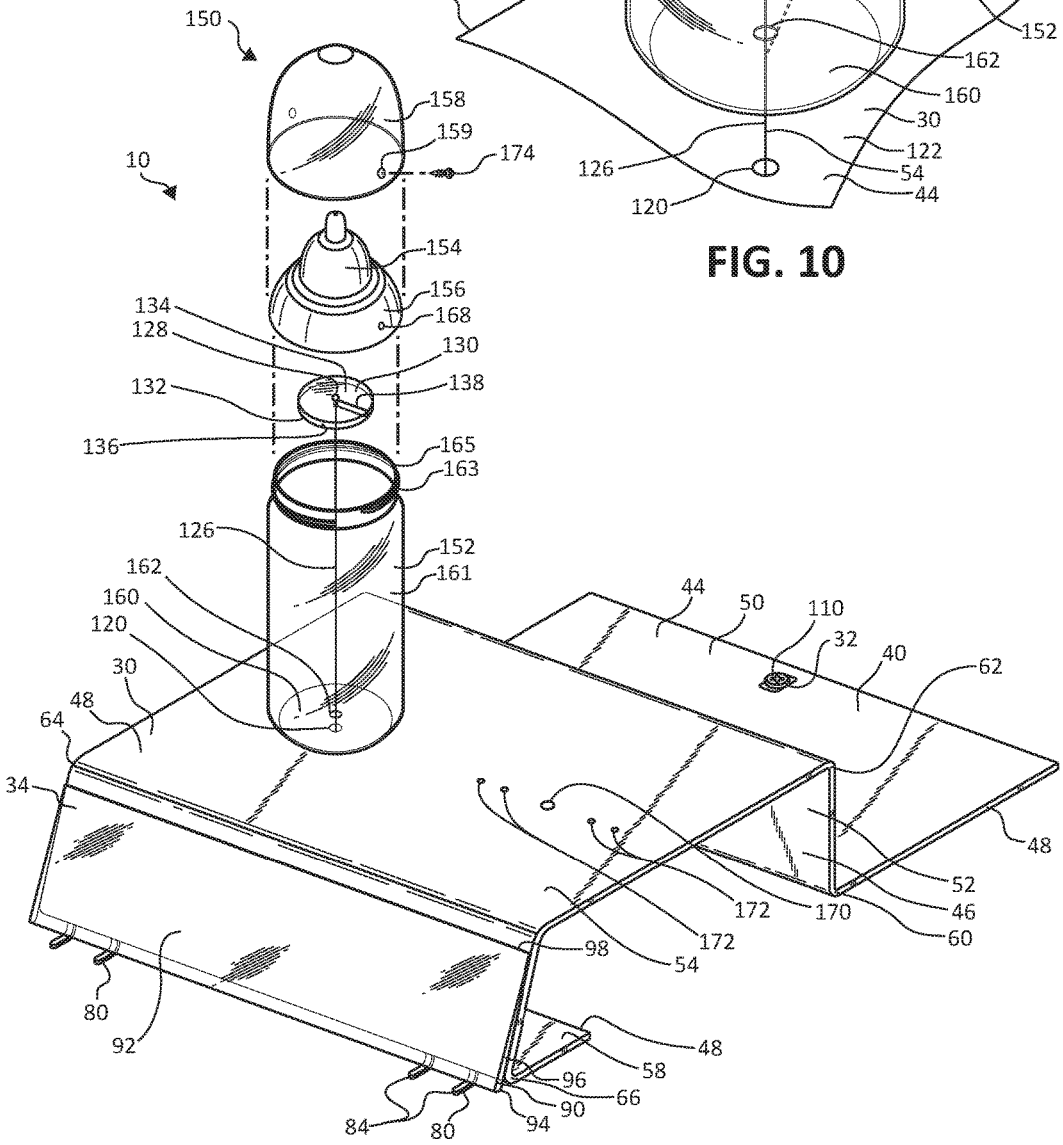
FIG. 9 is a perspective view illustration of the display fixture of FIG. 2 with a sample product, according to one embodiment of the present invention.

In one embodiment, product 16 (FIG. 1) is a baby bottle assembly 150 including a bottle 152 and optionally including a nipple 154, a coupling collar 156, and/or a cover 158 as illustrated in FIG. 9. Bottle assembly 150 and the components thereof are representative of substantially identical bottle assemblies and components thereof (not shown) being offered for sale. Bottle 152 defines, in one example, a bottom panel 160, a sidewall 161 extending upwardly from a perimeter of bottom panel 160 to a threaded neck 163 adjacent a top opening 165 opposite bottom panel 160.

To facilitate coupling bottle 152 with display fixture 10, in one embodiment, an aperture 162 is created through bottom panel 160 of bottle 152 having an overall diameter just greater than an overall diameter of ball end 128 at end of tether 126, where a similar aperture is not included in the corresponding bottles 152 being offered for sale. Tether 126 is pulled upwardly away from platform segment 54 through aperture 120 such that an extended length of tether 126 is held above platform segment 54, for example as shown in FIG. 9. While tether 126 is extended, ball end 128 of tether 126 is moved through aperture 162 in bottom panel 160 of bottle, and up through top opening 165. While ball end 128 is extended above top opening 165, coupling plate 130 is slid relative to ball end 128 to move tether 126 through slot 138 to center portion of coupling plate 130, and ball end 128 and tether 126 is released allowing biasing on tether 126 to pull tether 126 to nest in interior end 140 of slot 138. The bias on tether 126 further pulls coupling plate 130 toward aperture 120, and interaction of coupling plate 130 with bottom panel 160 of bottle 152 pulls bottle toward exterior surface 44 formed by platform segment 54 about aperture 120.

In one example, top opening 165 of bottle 152 is sealed with any suitable covering member. As illustrated, top opening 165 of bottle 152 is covered with a nipple 154 and coupling collar 156 sold together with or as a separate accessory for use with bottle 152. Coupling collar 156 is generally secured to bottle 152 via threaded neck 163 or otherwise, as it would typically be coupled thereto during use. In one example, coupling collar 156 is additionally substantially permanently secured to bottle 152 with one or more additional securement mechanisms, such as adhesive (not shown), screws 174, etc. to generally prevent consumer tampering with coupling plate 130 that would allow bottle 152 to be removed from display fixture 10 and perhaps even stolen from the corresponding retail location.

In one example, a cover 158 as is sold together with or as a separate accessory for use with bottle 152 is coupled to coupling collar 156 to fully enclose nipple 154 as typical for storage and transport of bottle 152 during end consumer use. In one example, cover 158 is additionally substantially permanently secured to bottle 152 with one or more additional securement mechanisms, such as adhesive (not shown), screws 174 through apertures 159 therethrough, etc. to generally prevent consumer tampering with or removing cover 158 from bottle 152 and separating it from the display. In one embodiment, a single securement member, such as screw 174, extends through aperture 159 in cover 158, aperture 168 in coupling collar 156, and into threaded neck 163 to securely couple cover 158, coupling collar 156, and bottle 152 to each other.

Once bottle 152 and/or bottle assembly 150 as a whole is secured to display fixture 10 via coupling plate 130, a consumer considering purchase of substantially identical bottles, bottle assemblies and/or components thereof (not shown) on a shelf or other storage unit nearby can inspect the sample bottle assembly 150 rather than needing to open the boxes containing the substantially identical products for purchase. The consumer is able to grasp bottle 152 cover 158 and to tactilely and visually inspect the same along with other features of bottle assembly 150 to make a more fully informed decision regarding what type of baby bottle (or other displayed product) to purchase. While allowing for consumer inspection tether 126 maintains bottle assembly 150 coupled to display fixture 10, which prevents theft and/or other displacement or loss of bottle assembly 150 from retail display system 14.

In one example, display fixture 10 is configured to support a second product 16 on platform segment 54. In one embodiment, where cover 158 fully encloses nipple 154 and coupling collar 156 in a manner preventing tactile and/or visual consumer interaction therewith, platform segment 54 is configured to support an additional product 16, for example, another substantially identical, a corresponding, or an entirely different coupling collar 156 and nipple 154 allowing for tactile consumer interaction with coupling collar 156 and/or nipple 154. In one such embodiment, platform segment 54 includes one or more additional apertures, such as center aperture 170 and pairs of coupling apertures 172, as illustrated in FIG. 9, at least some of which facilitate coupling the coupling collar 156 and nipple 154, or other product 16, to display fixture 10.

For example, each pair of coupling apertures 172 is positioned to fit on opposing sides of a point of coupling collar 156 adjacent a corresponding aperture 168 through sidewall 164 of coupling collar 156. More specifically, one aperture of the pair of coupling apertures 172 is located on an interior side of an interior surface 167 of coupling collar 156 while the other aperture of the same pair of coupling apertures 172 is positioned on an exterior side of coupling collar 156. In one example, second or additional pairs of coupling apertures 172 are evenly spaced about a circumference of coupling collar 156. As illustrated, platform segment 54 includes two pairs of coupling apertures 172 diametrically opposed to one another relative to coupling collar 156.

The second coupling collar 156 is secured to platform segment 54 of display fixture 10 via a different cable tie, coupling straps, or other suitable fastener 178 extending through each pair of coupling apertures 172, in one example. Each such fastener 178 is thread from interior surface 46 of platform segment 54, up through one aperture of a pair of coupling apertures 172, through a corresponding aperture 168 in coupling collar 156 and into interior cavity 169, and back down through the other aperture of the same pair of coupling apertures 172, to be rather secured to itself or other member. In one example, very little slack or extra length of fastener 178 is provided such that bottom edge 176 of coupling collar 156 is tightly secured immediately adjacent to exterior surface 44 of platform segment 54. In this manner, coupling collar 156 cannot be readily removed from display fixture 10 without significant damage to some portion of retail display system 14.

In one example, where second product 16 is a coupling collar 156 and a nipple 154 of a baby bottle assembly 150, issues can occur with nipple 154 collapsing. More specifically, nipple 154, like most baby bottle nipples is typically flexible. While nipple 154 may have some resiliency, if enough force is applied to nipple 154 pushing into nipple (for example, in a manner more exaggerated than that shown by the finger in FIG. 12) nipple 154 is subject to collapse or indent permanently or semi-permanently. In one example, center aperture 170 allows air to circulate from below nipple 154 to help decrease such indentation, whether inadvertently or intentionally caused by one or more consumers.

Figure 11:
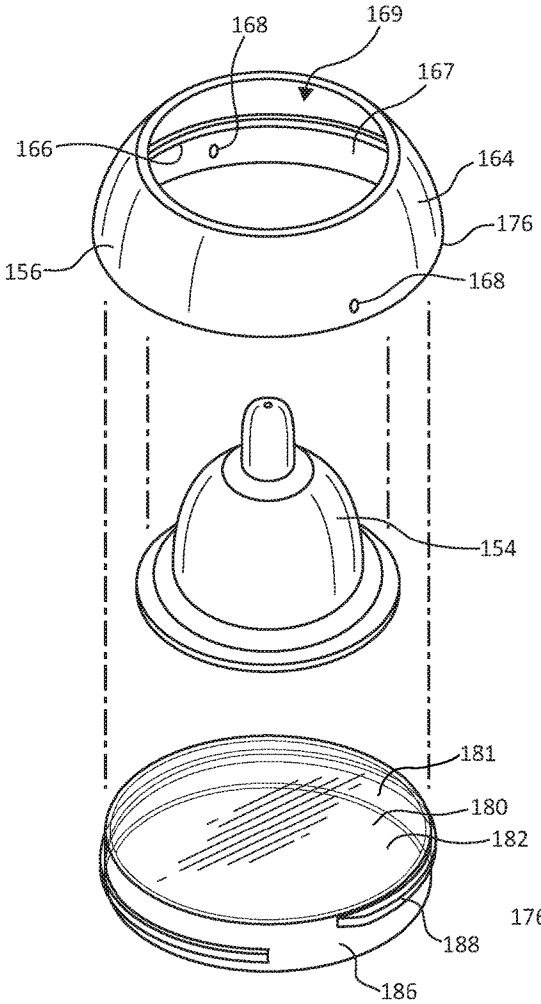
FIG. 11 is an exploded, perspective view illustration of a sample product and coupling plate, according to one embodiment of the present invention.

An interior puck 180 is additionally or alternatively used, in one embodiment, to further prevent collapse or indentation of nipple 154. For example, as illustrated with reference to FIGS. 11 and 12, an interior puck 180 is placed in interior cavity 169 of coupling collar 156 to block a portion of interior cavity 169 in a manner preventing collapse of nipple 154 all the way into interior cavity 169. As illustrated, interior puck 180 includes a top blocking panel 181 and a sidewall 186 extending downwardly from a perimeter thereof. Blocking panel 181 includes a top surface 182 and an opposite bottom surface 184.

A puck cavity 190 is formed between bottom surface 184 of blocking panel 181 and sidewall 186. In one example, sidewall 186 includes externally extending threads 188 configured to rotatably couple with interior facing collar threads 166, included on interior surface 167 of coupling collar 156 to couple with threaded neck 163 of bottle 152. In this manner, in one example, threads 188 of interior puck 180 are substantially identical to threads on threaded neck 163 of bottle 152. In one example, interior puck is formed via injection molding and/or ultrasonic welding two or more formed pieces to one another.

Figure 12:
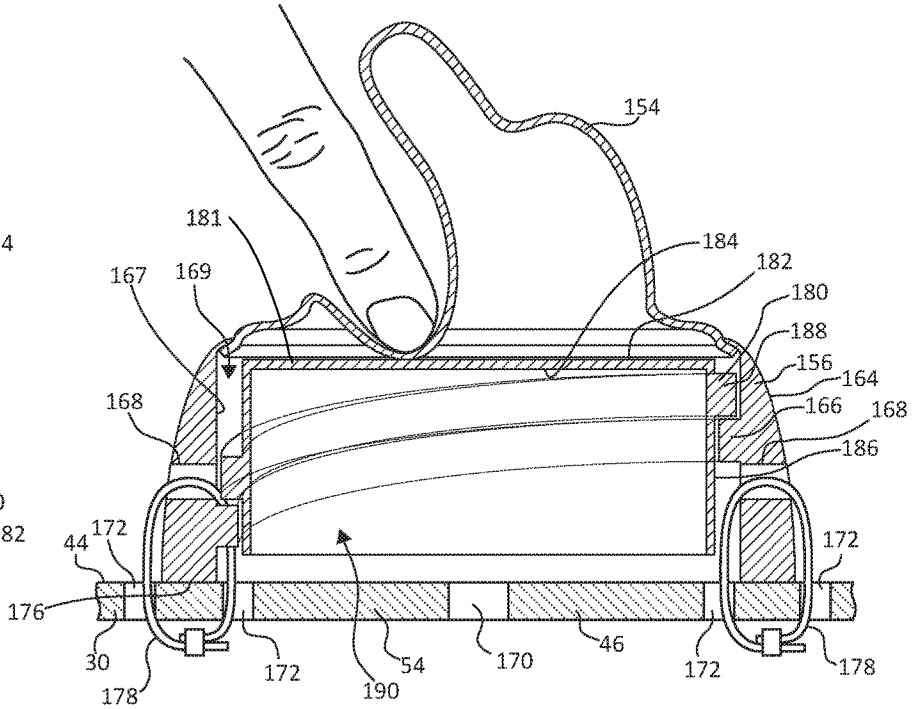
FIG. 12 is a cross sectional view illustration of a portion of the display fixture and sample product taken along the line X-X in FIG. 1, according to one embodiment of the present invention.

Interior puck 180 is placed in interior cavity 169 of coupling collar and pressed upwardly and rotated causing threads 188 of interior puck to interface and securely couple with collar threads 166. Further rotation of coupling collar 156 relative to interior puck 180 moves interior puck up within interior cavity 169 until blocking panel 181 of interior puck sits just below a top edge of coupling collar 156. In this manner, blocking panel 181 forms a blocking surface substantially preventing indentation of nipple 154 any further into interior cavity 169 than is shown in FIG. 12. The limited allowed deformation of nipple 154 substantially prevents nipple 154 from extending passed its point of resilience such that even after the finger in FIG. 12 is removed, nipple 154 returns to near its original position and configuration. In this manner, products 16 retain their integrity as representative products of the nearby packaged products offered for retail sale.

In one embodiment, interior puck 180 is formed as a single piece or assembled piece that is substantially transparent such that interior puck 180 is not readily seen through nipple 154 and/or coupling collar 156 even when nipple 154 and/or coupling collar 156 is translucent and/or transparent so as not to visually distract from the details of products 16 themselves. In one example, interior puck 180 entirely blocks a passable to nipple 154 from therebelow such that interior puck 180 cannot be included in coupling collar 156 during any actual use of nipple 154 for providing fluids therethrough.

Figure 13:
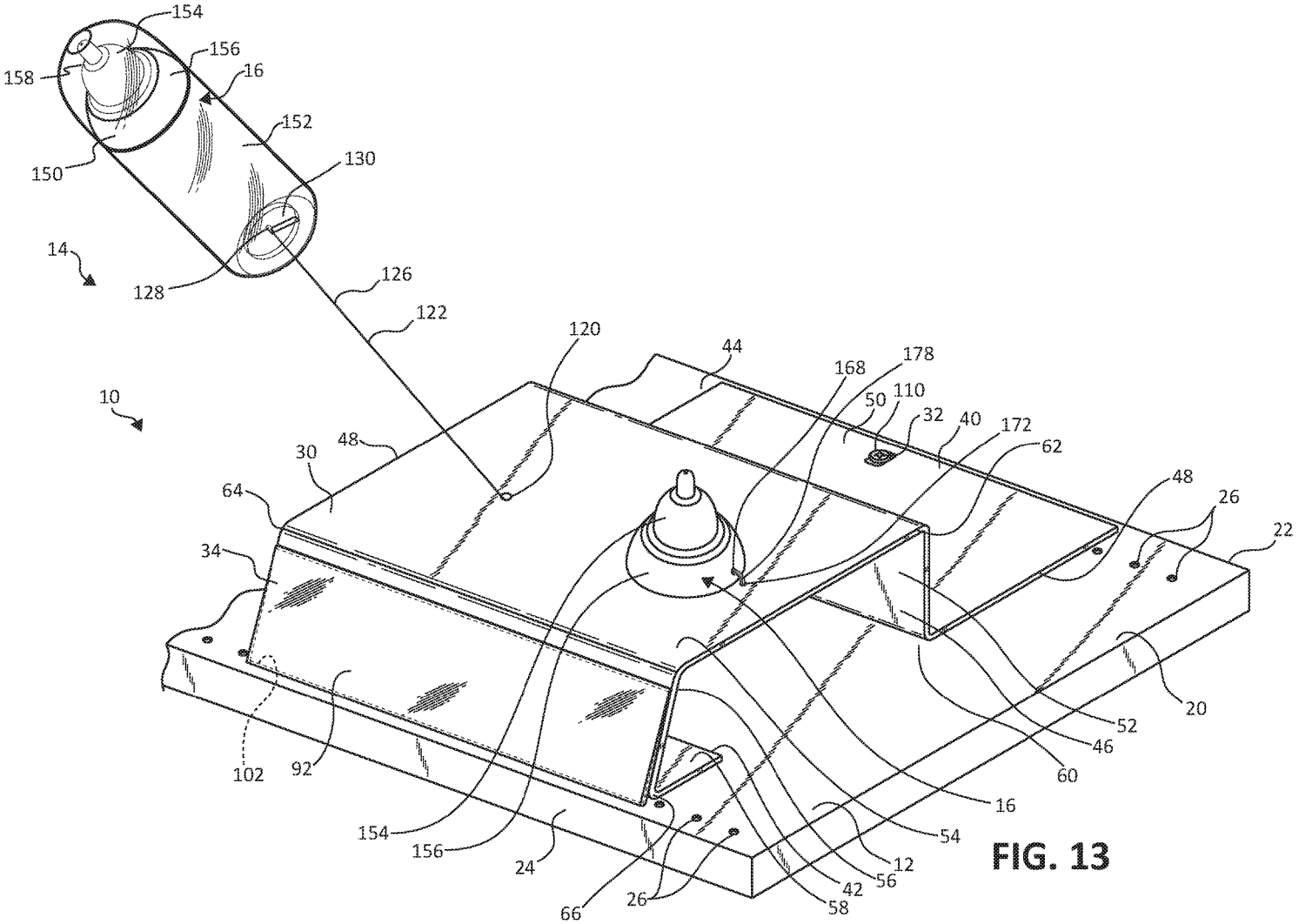
FIG. 13 is a front perspective view illustration of the display fixture installed as part of the retail display with sample products coupled thereto, according to one embodiment of the present invention.

Once products 16, as pictured bottle assembly 150 and secondary coupling collar 156 and nipple 154, are coupled to platform segment 54, display fixture 10 is secured within retail display system 14 as shown, for example, in FIGS. 1 and 13. In particular, prongs 84 of coupling hooks 80, as best illustrated in FIGS. 2-8, are each placed into alignment with a different aperture of the array of apertures 26 along front edge 24 of a selected shelf 12. Display fixture 10 is rotated downwardly about hook 80 interactions with the array of apertures 26 until front coupling flange 58 rear coupling flange 50 are placed in contact with top panel 20 of shelf 12. In one example, exterior surface 44 of front coupling flange 58 and interior surface 46 of rear coupling flange each are placed to directly abut a top surface of top panel 20 of shelf 12.

When display fixture 10 is positioned for selective coupling with shelf 12, as described above, tether housing 124 is maintained in a void created by display fixture 10 between top panel 20 of shelf and platform segment 54, riser segment 52, and front facing segment 56 such that tether housing 124 is substantially hidden from view when display fixture 10 is viewed from a front portion thereof. The vertical spacing of platform segment 54 from top panel 20 of shelf 12 also provides a stage effect visually promoting the importance of products 16 while also providing a front facing sign holder 34 just below products 16 to facilitate display of sign 102 having informational, sales, and marketing information related to products 16. Presentation of tactilely and visually accessible sample products 16 immediately adjacent information about the corresponding products 16 offered for sale allows a consumer to quickly learn about the provided options for similar products, e.g., bottle assemblies 150, and to compare such products to one another to make a more informed decision about what type of product, e.g., bottle assembly 150, to purchase. As a result, the consumer is able to make an efficient decision that gives them peace of mind and satisfaction in the overall shopping experience.

In one example, a rear fastener 110, such as a nut and bolt, screw, rivet, etc. is secured to extend through rear coupling flange 50 and one of apertures 26 along rear edge 22 of shelf 12 in a manner substantially preventing vertical movement of rear coupling flange 50 without use of a tool to remove rear fastener 110 from display fixture 10. In this manner, products 16 are securely held to display fixture 10 and display fixture 10 is securely held to shelf 12 of retail display system 14 making it difficult to remove products 16 from retail display system 14. This difficulty in removing products 16 from retail display system 14 prevents theft, vandalism, and/or inadvertent removal of products 16 from retail display system 14 that would otherwise deter the effectiveness of products 16 serving as tactilely accessible samples for corresponding packaged products (not shown) being offered for retail sale.

Although the invention has been described with respect to particular embodiments, such embodiments are meant for illustrative purposes only and should not be considered to limit the invention. For example, while the sample products are primarily described as being baby bottle assemblies or portions thereof, it will be understood that the display fixture as described herein is suitable for supporting a large number of product types, e.g., kitchen appliances, storage components, beauty aids, health aids, electronic components, etc. In addition, while primarily illustrated as including both a tether and an interior puck various display fixtures may include only one of the tether and the interior puck. Various other alternatives, changes, and applications will be apparent to those of ordinary skill in the art upon reading this application. Other modifications within the scope of the invention and its various embodiments will be apparent to those of ordinary skill.

What is claimed is:

1. A display fixture for supporting a sample product on a retail display shelf, the display fixture comprising:

a platform segment defining a top surface, a bottom surface, and an aperture extending from the top surface to the bottom surface;

a tether assembly including a tether housing positioned below the bottom surface of the platform segment and a tether extending from the tether housing and through the aperture of the platform segment, wherein the tether is selectively retractable from the tether housing and is biased toward maintenance of the tether inside the tether housing;

a coupling plate having an outer perimeter and a slot extending from the outer perimeter into an interior of the coupling plate, the slot terminating at an enlarged end opposite the outer perimeter;

wherein:

the tether extends through the slot and terminates in a ball end, the ball end nests in the enlarged end of the slot such that the tether is coupled to the coupling plate, the display fixture additionally includes a rear coupling flange and a front coupling flange, the rear coupling flange and the front coupling flange are substantially coplanar with one another and substantially parallel with the platform segment, and the platform segment is spaced above the rear coupling flange and the front coupling flange such that the tether housing is maintained above each of the front coupling flange and the rear coupling flange.

2. The display fixture of claim 1, wherein the ball end of the tether nests in the enlarged end of the slot such that the tether is coupled to the coupling plate without the use of an additional securement mechanism.

3. The display fixture of claim 1, wherein the front coupling flange, the platform segment, and the rear coupling flange are formed from a single piece of material.

4. The display fixture of claim 1, wherein the front coupling flange includes coupling hooks each having at least one prong configured to be received by holes along a front edge of the retail display shelf.

5. The display fixture of claim 4, wherein the rear coupling flange includes a fastener configure to couple with the retail display shelf to substantially prevent vertical movement of the rear coupling flange relative to the retail display shelf.

6. The display fixture of claim 1, wherein the coupling plate is a coupling disk.

7. The display fixture of claim 1, wherein the coupling plate is larger than the aperture of the platform segment such that the coupling plate maintains the ball end of the tether above the top surface of the platform segment.

8. The display fixture of claim 1, in combination with the sample product, the coupling plate being entirely sealed within the sample product.

9. The display fixture of claim 1, in combination with the sample product, wherein the product is substantially permanently closed about the coupling disk via one or more fasteners.

10. A combination including:

a sample product including a baby bottle, a display fixture for supporting a sample product on a retail display shelf, the display fixture comprising:

a platform segment defining a top surface, a bottom surface, and an aperture extending from the top surface to the bottom surface;

a tether assembly including a tether housing positioned below the bottom surface of the platform segment and a tether extending from the tether housing and through the aperture of the platform segment, wherein the tether is selectively retractable from the tether housing and is biased toward maintenance of the tether inside the tether housing;

a coupling plate having an outer perimeter and a slot extending from the outer perimeter into an interior of the coupling plate, the slot terminating at an enlarged end opposite the outer perimeter;

wherein:

the tether extends through the slot and terminates in a ball end, the ball end nests in the enlarged end of the slot such that the tether is coupled to the coupling plate, the baby bottle includes a bottom panel with a bottle aperture extending therethrough, the bottle aperture being sized larger than a greatest width of the tether and smaller than a smallest width of the coupling plate, the tether extends through the bottle aperture, and the coupling plate is secured to the tether inside the baby bottle.

11. The display fixture claim 10 in combination with the sample product, wherein:

the baby bottle includes an opening opposite the bottom panel, the sample product includes a nipple covering the opening and coupled about the opening via a coupling collar, and the coupling collar is secured to the bottle via a secure fastening agent such that the coupling plate is secured inside the baby bottle.

12. A display fixture for supporting a sample product on a retail display shelf, the display fixture comprising:

a platform segment defining a top surface, a bottom surface, and an aperture extending from the top surface to the bottom surface;

a tether assembly including a tether housing positioned below the bottom surface of the platform segment and a tether extending from the tether housing and through the aperture of the platform segment, wherein the tether is selectively retractable from the tether housing and is biased toward maintenance of the tether inside the tether housing;

a coupling plate having an outer perimeter and a slot extending from the outer perimeter into an interior of the coupling plate, the slot terminating at an enlarged end opposite the outer perimeter;

wherein:

the tether extends through the slot and terminates in a ball end, the ball end nests in the enlarged end of the slot such that the tether is coupled to the coupling plate, the sample product is a first sample product, the display fixture is configured to support a second sample product, the platform segment includes pairs of coupling apertures, and the display fixture includes coupling straps extending through each aperture of the pair of apertures and through a portion of the second sample product to secure the second sample product to the platform segment.

13. The display fixture of claim 12, wherein:

the second sample product includes a nipple for a baby bottle and a coupling collar for securing the nipple to the baby bottle, the coupling collar is secured to the nipple in a manner that the coupling collar would be secured to the nipple during use of the nipple and the coupling collar on the baby bottle, the display fixture includes an interior puck threadably secured with the coupling collar and maintained within an interior cavity of the coupling collar, the interior puck including a blocking panel positioned near a top edge of the coupling collar of the second sample product to prevent deformation of the nipple into the interior cavity of the coupling collar beyond the blocking panel.

14. The display fixture of claim 13, wherein the interior puck is formed of a single piece of material including threads for rotatable coupling with the coupling collar and the blocking panel.

15. The display fixture of claim 12, wherein the second sample product includes components identical to components of the first sample product.

16. The display fixture of claim 12, wherein the second sample product includes components configured for selective use with components of the first sample product.

17. A retail display comprising:

a sample baby bottle nipple and a coupling collar coupled with the sample baby bottle nipple, the coupling collar including interior facing threads, for selectively coupling with a threaded neck of a baby bottle, and a top edge, the nipple extending above the top edge of the coupling collar; and a display fixture comprising:

a platform including a top surface, wherein the coupling collar is secured to the platform and is positioned above top surface of the platform, and an interior puck including a blocking panel and sidewalls depending from a perimeter of the blocking panel, the sidewall including exterior facing threads rotably coupled with interior facing threads of the coupling collar to position the blocking panel above the top surface of the platform near the top edge of the coupling collar to substantially prevent deformation of the nipple into a cavity of the coupling collar beyond the blocking panel.

18. A method of forming a retail display system, the method comprising:

providing a display fixture comprising a platform segment, a tether assembly, and a coupling plate, wherein the platform segment defines a top surface, a bottom surface, and an aperture extending from the top surface to the bottom surface, the tether assembly includes a tether housing positioned below the bottom surface of the platform segment and a tether extending from the tether housing and through the aperture of the platform segment, the tether is selectively retractable from the tether housing and biased toward maintaining the tether inside the tether housing, and the coupling plate defines an outer perimeter and a slot extending from the outer perimeter into an interior of the coupling plate such that the slot terminates at an enlarged end opposite the outer perimeter;

coupling a sample product to the display fixture, the sample product including a bottle having an open top and a cover configured to extend over the open top, wherein coupling the sample product to the display fixture includes:

extending the tether away from the top surface of the platform segment, threading a ball end of the tether, formed opposite a coupling of the tether to the tether housing, through a hole in a bottom of the bottle, extending the tether to extend through the bottle and out the open top of the bottle, while the tether extends out the open top of the bottle, securing the coupling plate to the ball end of the tether without the use of an additional securement mechanism, releasing the tether to pull the bottle toward the platform segment and position the coupling plate within the bottle, and securing the cover to the bottle to fully seal the coupling plate within the bottle.

19. The method of claim 18, further comprising:

providing a bottle nipple and a coupling collar coupled with the bottle nipple, and threadably coupling a blocking panel to the coupling collar such that the blocking panel extends across a cavity of the coupling collar near a top edge of the coupling collar to substantially prevent deformation of the bottle nipple into the cavity of the coupling collar beyond the position of the blocking panel.

* * * * *